US005312120A

United States Patent [19]

Wiegner

[11] Patent Number: 5,312,120

[45] Date of Patent: May 17, 1994

[54] ROLLER-SKI

[76] Inventor: Georg Wiegner, 3/c Block 2, 16 La Salle Road, Kowloon, Hong Kong

[21] Appl. No.: 1,948

[22] Filed: Jan. 4, 1993

Related U.S. Application Data

[63] Continuation of Ser. No. 790,363, Nov. 12, 1991, abandoned.

[30] Foreign Application Priority Data

Nov. 15, 1990 [DE] Fed. Rep. of Germany ..... 4036526
Jul. 18, 1991 [DE] Fed. Rep. of Germany ..... 4123822

[51] Int. Cl.[5] ..... A63C 17/14

[52] U.S. Cl. ..... 280/11.2; 280/11.23; 280/11.27; 280/11.28

[58] Field of Search ..... 280/11.2, 11.22, 11.23, 280/11.19, 11.3, 11.27, 11.28; 188/71.1, 72.1, 72.3, 72.9, 74, 75, 76, 325, 228, 70 R

[56] References Cited

U.S. PATENT DOCUMENTS 4,300,781 11/1981 Riggs ..... 280/11.2
4,943,072 7/1990 Henig ..... 280/11.2
4,943,075 7/1990 Gates ..... 280/11.23

*Primary Examiner*—Richard M. Camby
*Attorney, Agent, or Firm*—Felfe & Lynch

[57] ABSTRACT

In sport equipment in the form of short ski-like rollers for each foot, with a support as base for the shoe of the user and only one front wheel and one rear wheel each, a particularly compact and maneuverable construction of the equipment is achieved owing to the fact that the front wheel and the rear wheel and their axes are disposed within the longitudinal extent of the support.

1 Claim, 8 Drawing Sheets

Fig. 4
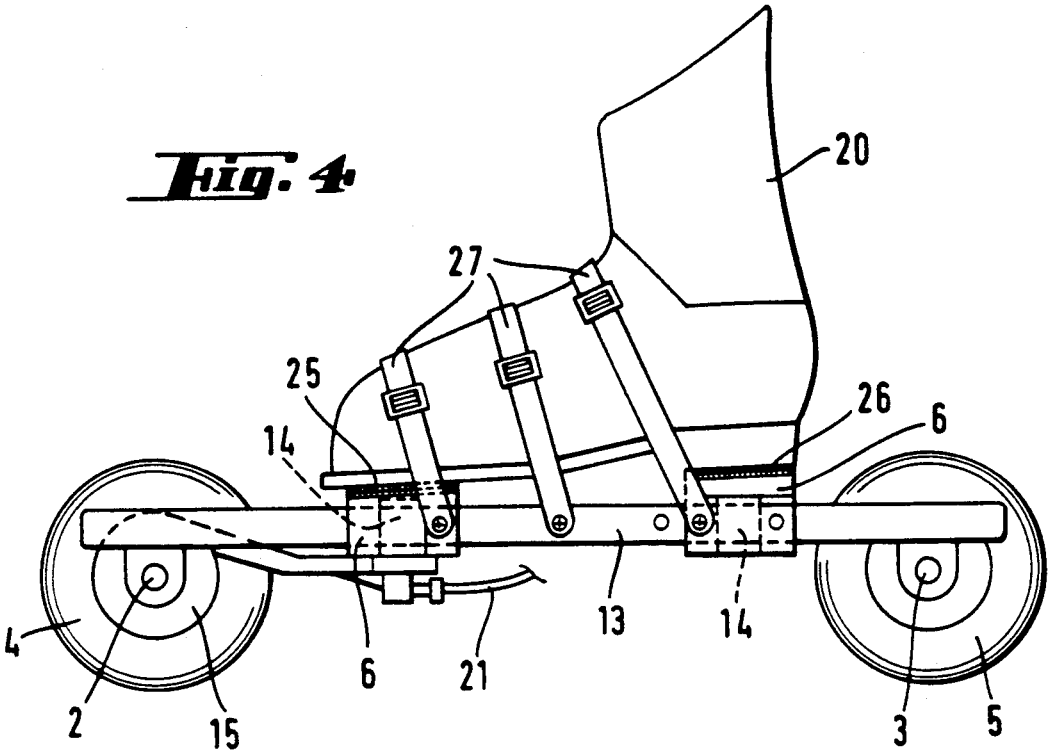
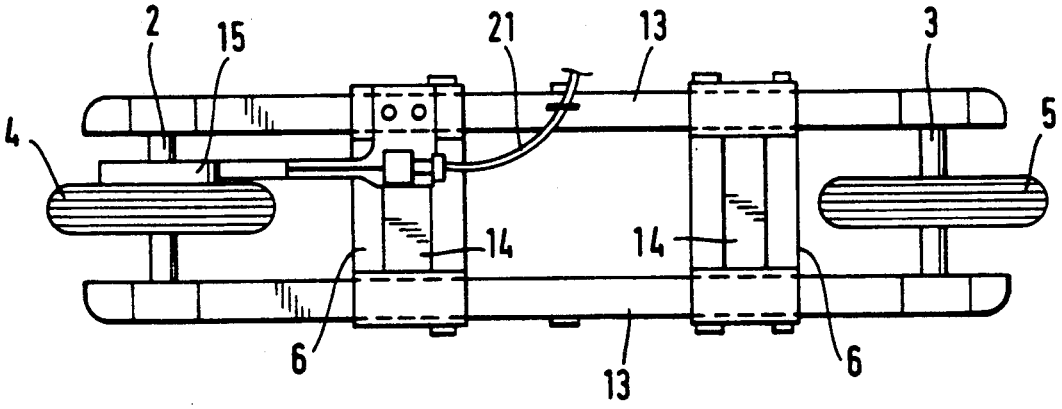
Fig. 5

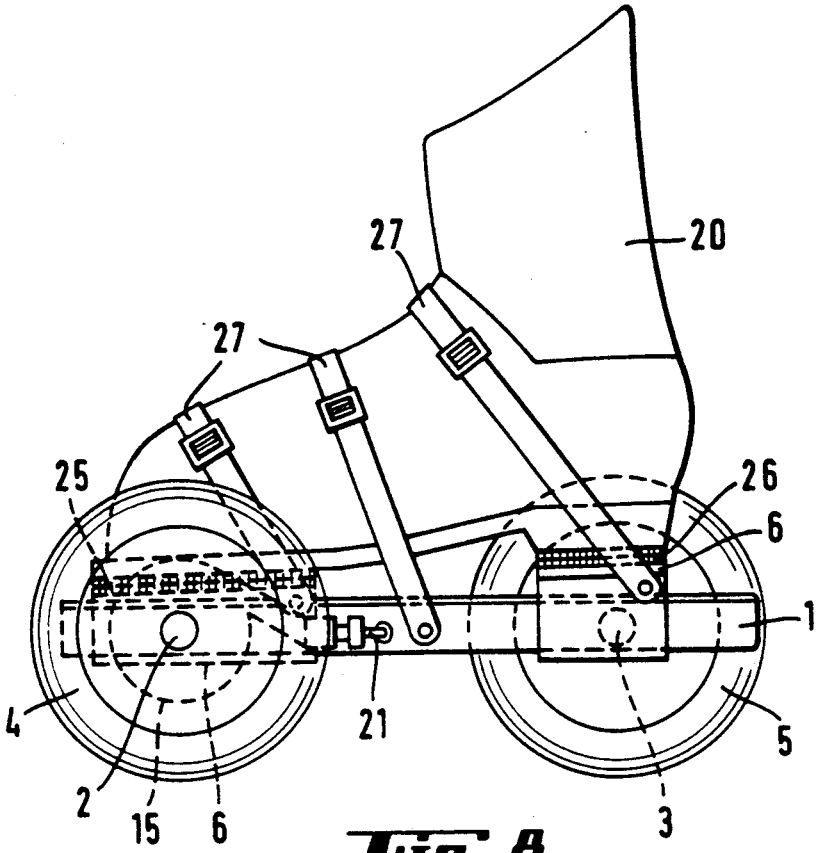
Fig. 8
Fig. 9
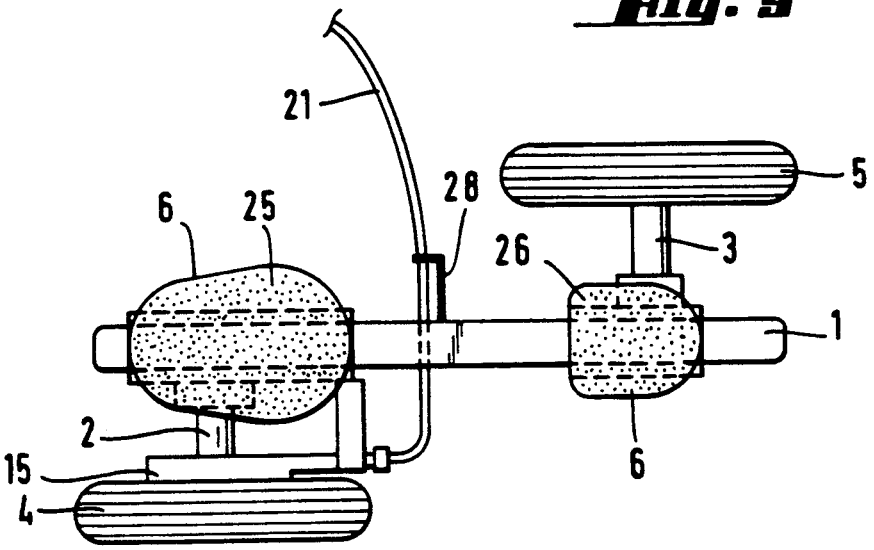

Fig. 14
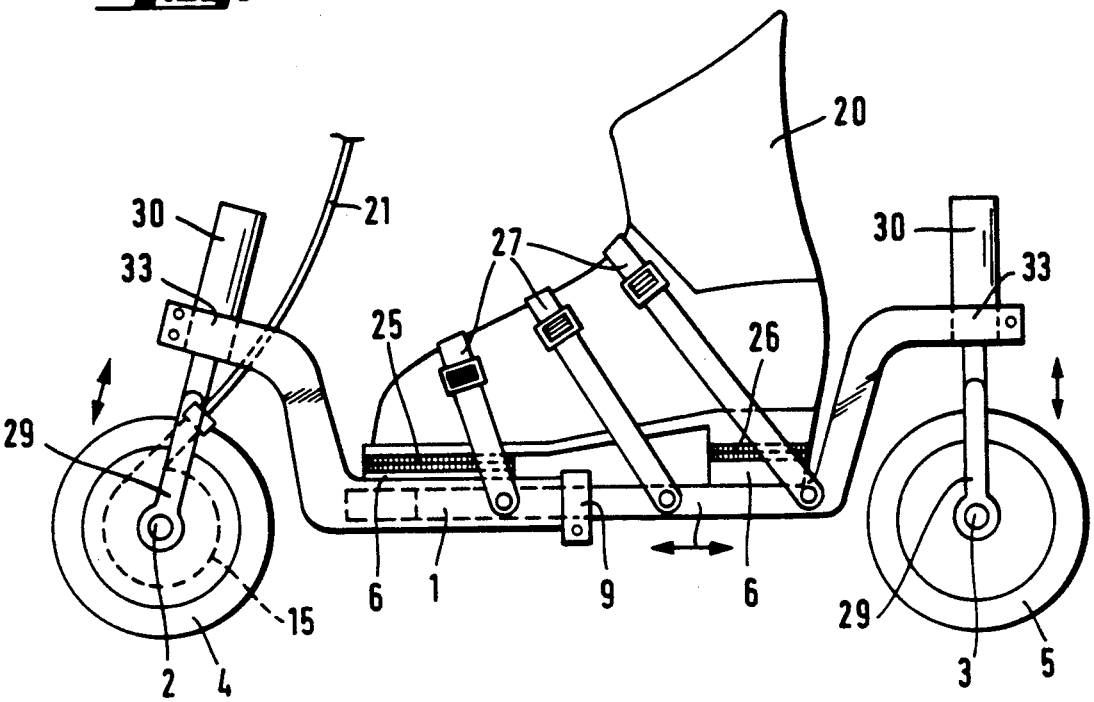
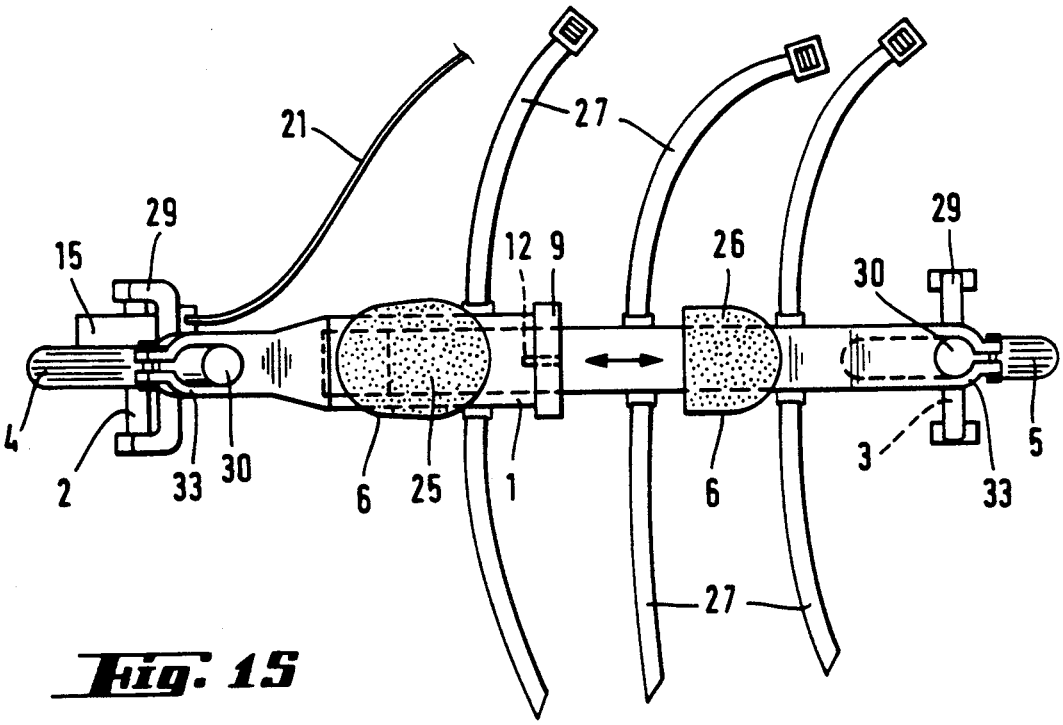
Fig. 15

ROLLER-SKI

This application is a continuation of application Ser. No. 07/790,363, filed Nov. 12, 1991, now abandoned.

FIELD OF THE INVENTION

The invention relates to novel sport equipment, which comprises a right and left short ski-like roller with a support as base for the shoe of the user, a shoe holder and a front wheel and a rear wheel mounted on an axis on the support and a brake system consisting of a brake and an operating mechanism.

BACKGROUND OF THE INVENTION

Since the ski season is limited to a few months of the year and, in addition, sufficient snow is a prerequisite for skiing, a series of proposals have already been made for remaining at least in training for also the remaining part of the year. This is important above all because skiing, perhaps more than any other type of sport, makes manifold physical demands on the body and requires the mastery of very different series of movements. An untrained sportsman frequently is not sufficiently fit for these high demands, so that ligament strains and tears, muscle strains and sprains, or even bone fractures result especially in the first days of a skiing vacation, and a vacation, which was intended to be for relaxation, frequently ends up in a hospital.

Various proposals have therefore already been made, for remaining in training also in the snow-free months or outside of the actual winter sport season, for example, by dry skiing exercises, etc. Sport equipment has also already been developed, which simulates at least the individual series of motions or permits these to be carried out. For example, skateboard-like equipment has been created, in which short ski-like supports have been provided with rollers and in this way permit movements which correspond at least to cross-country skiing. All of the previously known sport equipment has almost the same construction, which is similar to that known, for example, from German Gebrauchsmuster No. 89 04 308. They have a support as a base for the shoe of the user, a shoe holder similar to a ski binding and a front wheel and a rear wheel, which are mounted on the support, each on one axis. Two wheels are also frequently provided at the rear. In addition, this previously known equipment has a brake system consisting of a brake and a brake operating mechanism. The latter is accommodated in a ski pole and is connected with the brake by means of a Bowden cable.

It is a disadvantage of the previously known equipment that its materials are expensive, its safety is slight and it does not fully take into consideration the manifold series of motions, stresses and demands made on the sportsman.

OBJECTS OF THE INVENTION

It is therefore an object of the invention to improve further, make safer and to enable to be manufactured with less expenditure for materials and therefore more inexpensively such sport equipment of the generic type, and to be able to adapt it to the different types of requirements, such as maneuverability, high-speed skiing or the severest stresses on uneven tracts of land. This new sport equipment is also intended to offer a varient of roller skates and ice skates.

Pursuant to the invention, this extremely complex task is accomplished with sport equipment, in which the axes for attaching the wheels and the wheels themselves are disposed within the longitudinal extent of the support. By means of this measure, the sport equipment is shortened appreciably compared to the previously known state of the art, and the cost of the materials is therefore significantly less. However, the maneuverability achieved by these means and the safety and robustness, which are increased significantly by the compact construction, are of even greater significance.

Other objects and advantages of the present invention will become apparent as the description thereof proceeds.

DESCRIPTION OF THE INVENTION

Preferably, about $\frac{2}{3}$ of the diameter of the wheels is within the longitudinal extent of the support, so that the wheels protrude at the front and back with only small circular segments. Preferably, for a compact construction of the sport equipment, the axes to which the wheels are attached are disposed immediately below the support, and the diameter of the wheels is such that at least $\frac{1}{4}$ of the diameter of wheels is above the upper side of the support. A wheel diameter of between 10 and 20 cm has proven to be very appropriate. On the one hand, this wheel size is large enough to provide adequate running comfort, sufficient speeds and adequate shock absorption and, above all, to permit banking or tilting, as is customary during swings and other motions that reconstruct skiing.

On the other hand, this dimensioning accomplishes that the support is close to the ground. The center of gravity of the sport equipment therefore is low, and tilting away to the side and falls with serious consequences are avoided.

Preferably, the support is assembled from special profiled pipes so that it is possible to fall back on simple and easily accessible construction materials. For example, an appropriate embodiment consists in that two longitudinal side pieces and cross connectors are assembled and form a very stable support, between which a wheel is inserted at the front and at the rear.

The construction of the support from profiled pipes makes a further advantageous refinement of the sport equipment possible. This refinement enables the equipment to be used by a plurality of persons, such as the members of a family or the members of a sport club with different shoe sizes, in that the profiled pipes which extend in the longitudinal direction of the sport equipment, are divided and have a diameter such that they can be pushed inside one another in telescopic fashion and adapted in this way to the required shoe size. The same function is fulfilled by special profiled pipe parts of the same diameter, if they are connected to one another by means of a longer clamp.

In a further preferred embodiment, the support is formed from a U-shaped or T-shaped profile. Such a profile is associated with the advantage that the bearing surface for the shoe is particularly stable.

A different, advantageous and structurally simple refinement of the support consists in that it is constructed at the front and at the rear as a fork. With that, the accommodation of the wheels within the support is made possible. The middle part however, is left in one piece.

A further, advantageous possibility for making the gap of the shoe holder variable, so that the sport equipment can be used by users with different shoe sizes, consists in that the shoe holders are movably mounted on a guide rail of the special profiled pipe or of the U-shaped or T-shaped profile, so that, with effortless ease, preferably by loosening screws, the gap can be altered by shifting the shoe holders and fixed in the desired position again by tightening the screws.

A different possibility for adjusting the gap of the shoe holders, which consist of two parts, consists of putting a row of adjusting holes in the support and bringing about the adjustability with these.

In a particularly preferred embodiment of the sport equipment of this invention, at least one of the shoe holders, preferably however both, have a hook-and-loop fastener (Velcro®) element on the upper side, which forms a hook-and-loop fastener together with a hook-and-loop fastener element on the underside of the shoe, preferably under the sole and under the heel. This hook-and-loop fastener facilitates the handling, improves the use of the sport equipment and, in particular, provides manifold opportunities for employing the sport equipment.

In conventional roller skating and ice skating, the shoe and the roller skate or the ice skate are firmly screwed together and represent practically a unit. This has the advantage of a constantly optimum fit and great safety. However, it also has the very appreciable disadvantage that such roller skate or ice skate units are tailor-make for the user and that each family member, for example, requires this inseparable combination of shoe and actual sport equipment individually for himself or herself.

The hook-and-loop fastener makes a single piece of sport equipment usable in the above-described manner for different users with different shoe sizes. For the trade, this results in a considerable reduction in inventory, because it is no longer necessary to keep the whole of the equipment in all the usual sizes in stock. For the sport equipment with the hook-and-loop fastener that has been described, only one size of the sport equipment itself is now required and only the shoes must be kept in inventory in all the usual sizes. A further advantage of the use of a hook-and-loop fastener with the sport equipment lies in that the shoe is held absolutely firmly and every movement of the foot takes place without slippage. With this, the movements which are carried out by the user are transferred directly to the sport equipment. A further advantage lies in that due to the separation of shoe and sport equipment made possible in this way, the hook-and-loop fastener can be undone quickly by peeling apart, for example, in order to walk uphill in shoes alone, while carrying the sport equipment on the shoulders, and putting the sport equipment on again only when the terrain permits it.

Of special importance to the sport equipment of this invention in relationship to maneuverability, safety and simulation of the typical movement processes in skiing is the brake system, the basic principles of which are known and for which the brake is operated from an operating mechanism, preferably a handle, advisably also in conjunction with a ski pole, over a connecting line to the brake, advantageously in the form of a Bowden cable. Advantageously, the brake can also be operated by means of a remote electronic control. This has the advantage that there is no direct connection between the hand of the user and the sport equipment. Even when the Bowden cable is fixed to the sports clothing, such a direct connection has a certain susceptibility to fail and is easily damaged in the event of a fall, which cannot always be avoided.

The brake can be disposed on both sides of at least one of the wheels. This symmetrical arrangement is advantageous, above all, when high speeds without significant changes in direction are aimed for with the sport equipment. If the sport equipment is to be used for steep downhill skiing, it is advisable to have the bilateral brake on both wheels in order to be able to brake and come to a stop quickly. If both wheels are braked on both sides, the force is transferred to the brakes advantageously by way of a scissor-type lever, which is disposed below the support and is provided with spreading springs, which release the brake once again when the operating mechanism is released.

For most of the applications of the sport equipment, however, it is sufficient and advantageous if at least one of the wheels is provided with a brake, which advantageously is disposed on the outside. This embodiment has the advantage of not being very expensive and of mounting the brake where it is particularly effective for the motion processes aimed for and where it interferes least structurally. The brake is for this purpose constructed as a belt-brake and engages the wheels. In an advantageous variation of the braking system, the brake directly engages the rotating axes which carry the wheels.

It is essential for the sport equipment of the present invention that there be only one front wheel and one rear wheels, in order to be able to reconstruct swings and similar motions of skiing. Especially for the inexperienced user, there is of course a certain instability in having one front wheel and one rear wheel. Every beginning ice skater, for example, has to fight with such instability, which includes the danger of tipping over or sliding away. In order to reduce this risk, a further particularly preferred development of the invention lies in that the front wheel and rear wheel are disposed asymmetrically with respect to the longitudinal axis of the support. Such an arrangement is associated with the advantage that the sport equipment, as a whole, is considerably more stable, particularly with respect to the danger of tipping over. At the same time, it is not necessary to take into account the expense and the restricted mobility of a 4-wheel arrangement.

The improvement in the stability of the sport equipment and the prevention of the unintended tipping and lateral sliding motions can advantageously still be achieved owing to the fact that the middle part of the support, on which the shoe rests, is displaced toward the ground relative to the wheel axes, the position of which is determined by the diameter of the wheels. By these means, the center of gravity of the sport equipment as a whole is displaced toward the ground.

The displacement of the middle part of the support toward the ground makes possible a further, advantageous development of the sport equipment in such a manner, that the support is curved or bent upwards at both ends and the wheels are fastened in a horn plate, which is passed through the ends of the support or is otherwise connected with the ends of the support, for example, by way of clamps. In this connection, the horn plate can advantageously be constructed in two parts, so that the length of the horn plate is variable owing to the fact that the diameters of the two parts are such that they can be pushed one inside the other in telescope fashion. In the case of a 2-part horn plate with the same diameter, this variability in the length of the horn plate can be brought about with the help of clamps or bushings, in which the parts of the horn plate come up against one another or in which their ends are at a certain distance from one another, if a somewhat longer horn plate is desired. Advantageously, the horn plate is mounted on shock absorbers, so that this embodiment of the sport equipment is particularly suitable for use outside on paths and courses in undulating country.

The mobility and the adaptation of the motions of skiing, roller skating and ice skating is promoted by an advantageous variation of the invention, which consists in that the axis of at least one of the wheels is constructed as a sliding axis, where one or two springs force the wheel into the normal position, so that an offset arrangement of the front wheel and rear wheel, for example, results in a stabilized position similar to that usually brought about by a total of four wheels. On the other hand, when a swing motion is carried out, that is, when weight of the body is shifted to one side, the wheel is moved toward the support with compression of the spring; on returning to the upright position or when moving straight ahead, the wheel is pushed toward the outside again by the spring.

For changes in direction, such as those brought about, for example by the user by shifting his weight, the construction of at least one of the axes as a spiral gliding axis, in that one or two of the wheels are mounted on ball bearings in a slipping sleeve, has proven to be particularly outstanding. In this case, the wheel is stabilized in the middle by pressure springs for moving straight ahead. When pressure forces or centrifugal forces are produced as the user shifts his weight, the wheel slides by means of the slipping sleeve on the spiral gliding axis and thus facilitates mastery of curves and changes in direction. Advantageously, the sliding axis or spiral gliding axis is equipped with a catch, by means of which it can be made inoperable, so that the wheels run only centrically, as is appropriate for force acceleration.

The usefulness of the sport equipment of the instant invention can be increased in an advantageous manner by additional equipment with further accessories such as lights, speedometers, tachometers and trip meters. Since it is not impossible that the lateral outer regions of the support come into contact with the ground during swings and when cornering, it is advisable to protect these outer regions by wear-resistant coverings, which advantageously are exchangeable.

BRIEF DESCRIPTION OF THE DRAWINGS

The invention is explained in greater detail by means of the attached drawings, which represent preferred embodiments of the roller ski.

FIGS. 4 and 5 show the construction with 2 longitudinal side pieces and 2 cross connectors, as viewed from below and from the side.

FIGS. 8 and 9 show the construction with a front wheel and a rear wheel which are disposed offset with respect to the center line of the support.

FIGS. 14 and 15 show the embodiment with the middle part of the support shifted toward the ground and the ends bent upward, in side view and plan view.

The individual parts, which have the same function in the embodiments shown, have in each case been given the same reference symbol, even if the constructions are different.

Figure 1:
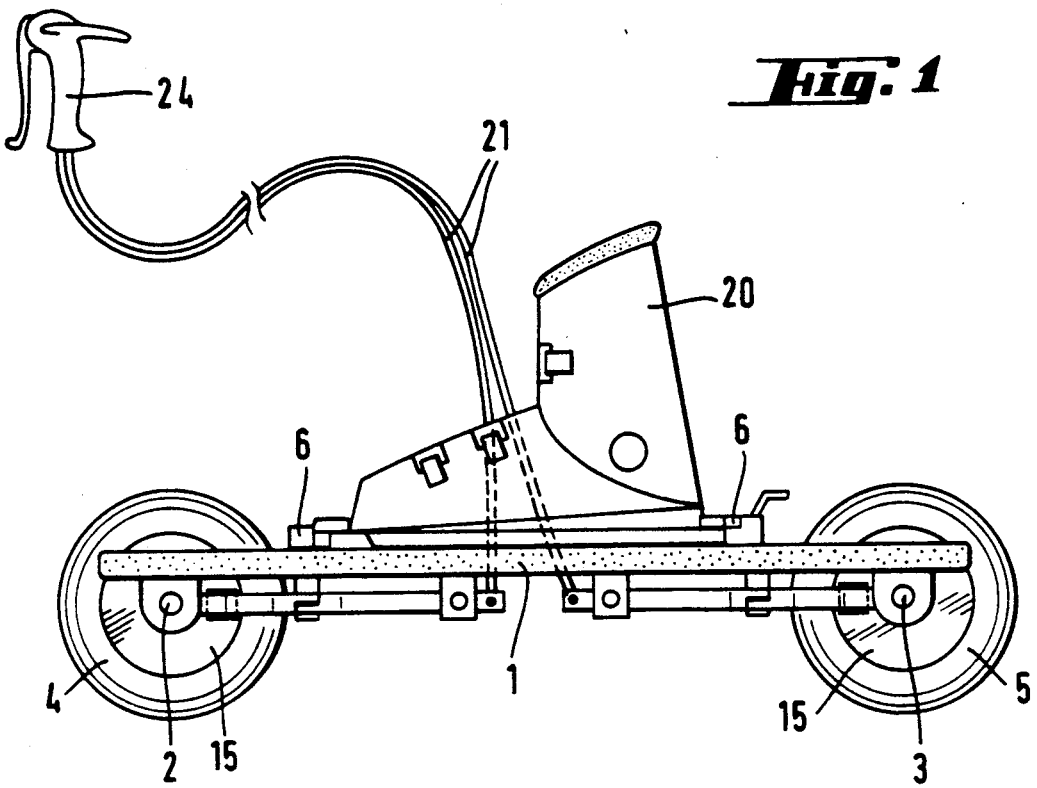
FIGS. 1, 2 and 3 show an embodiment with a brake on either side of each wheel.
Figure 2:
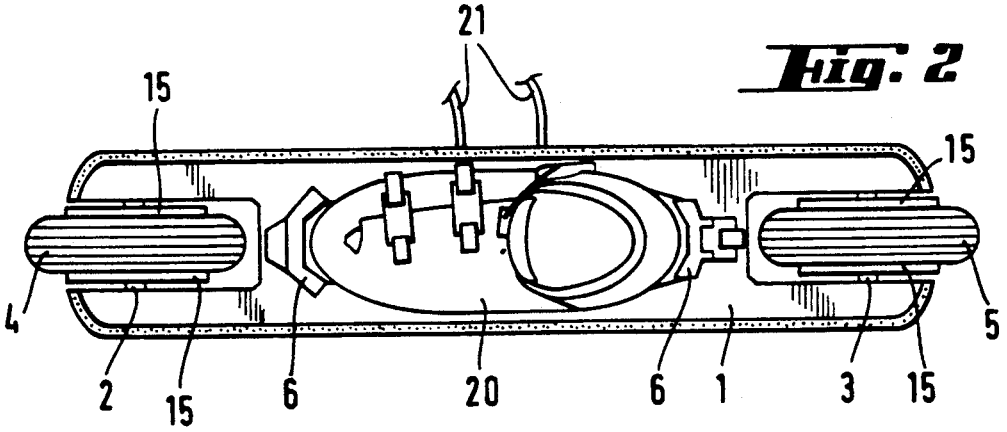
Figure 3:
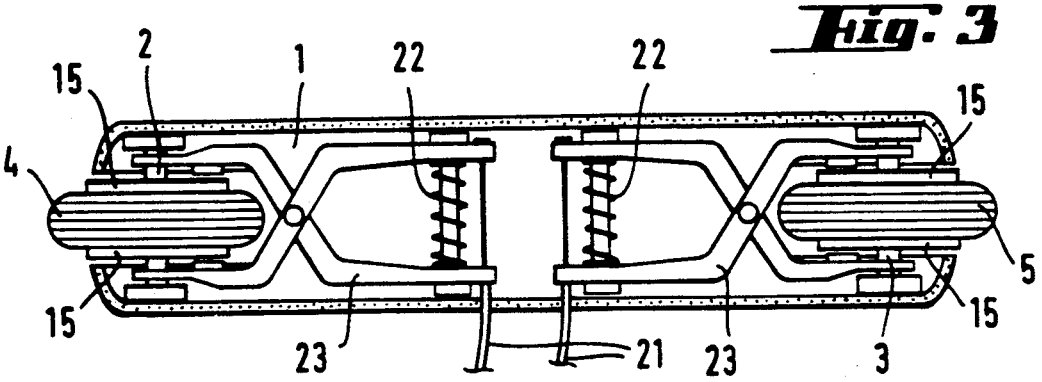

FIGS. 1, 2 and 3 show the basic construction of a roller-ski with bilateral braking of both wheels 4, 5. The support 1 consists of a ski board-like base plate with a 2-part shoe holder 6 for holding the shoe 20. The two wheels 4, 5 are disposed within the support 1 and attached to the axes 2, 3. On either side, the wheels have brakes 15, which are constructed as disk brakes and are connected over the Bowden cable 21 and the scissor-type lever 23, which is provided with spreading springs 22, with the respective operating mechanism 24 in the form of a handle. The arrangement of the wheels 4, 5 and the axes 2, 3 within the support 1 results in a very compact construction.

FIGS. 4 and 5 show a corresponding arrangement of the wheels 4, 5, which are mounted on axes, the right roller being shown as an example. The support 1 is formed here by two longitudinal side pieces 13 and two cross connectors 14. A front hook-and-loop fastener 25 and a rear hook-and-loop fastener 26 serve for putting on the support 1 and connecting it with the shoe 20. The rear hook-and-loop fastener 26 is somewhat higher in the form of a heel for shoes, in order to adapt the position of the shoe 20 better to the natural position of the foot. The shoe 20 is fixed in the vertical position on the support 1 by means of strap retainers 27. For this embodiment, a brake 15 in the form a belt brake is disposed only on the outside of the front wheel 4.

Figure 6:
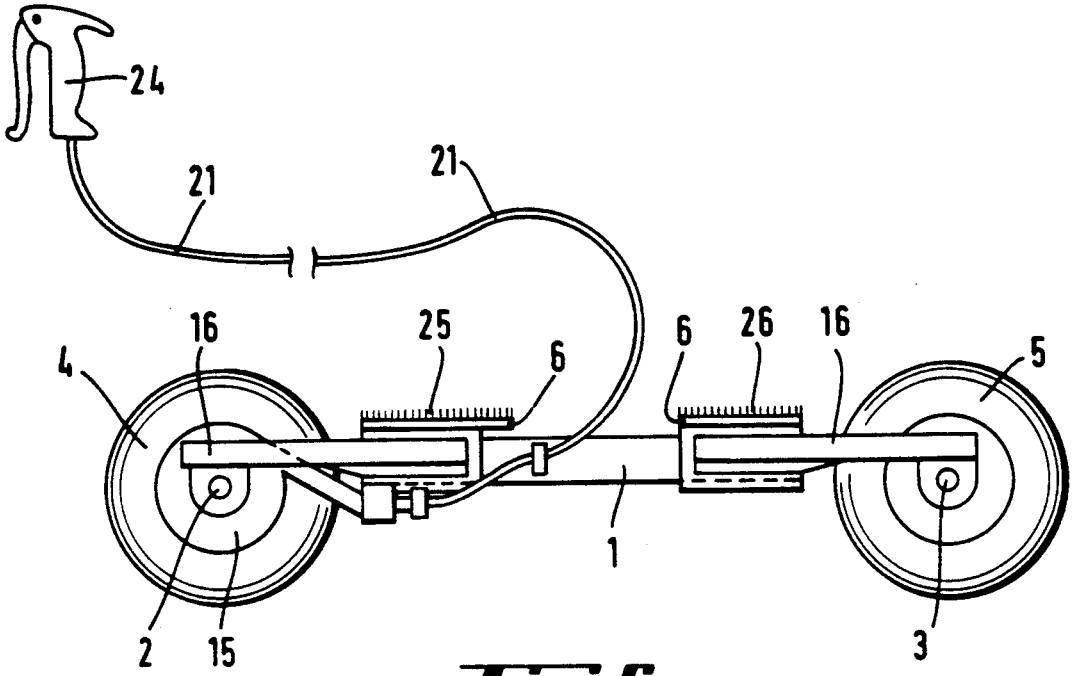
FIGS. 6 and 7 show the construction of the support as a double fork, as seen from below and from the side.
Figure 7:
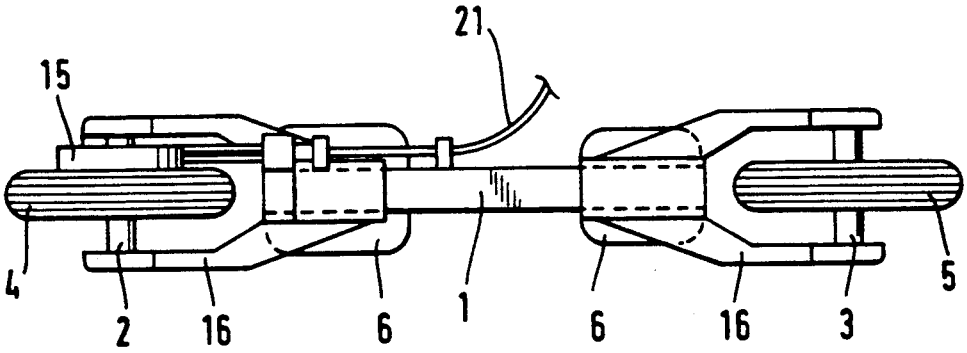

The embodiment of FIGS. 6 and 7 differs from that of FIGS. 4 and 5 in that the support 1 ends at the front and back in a fork 16, within which the wheels 4 and 5 and the axis 2 and 3 and, in the case of the front wheel 4, the unilateral brake 15 is inserted. This example also makes use of the hook-and-loop fastener. In FIG. 6, only one of the two interacting hook-and-loop fastener elements is shown, namely that fastened to shoe holder 6. However, reference symbols 25 and 26 have been retained for these.

Figure 10:
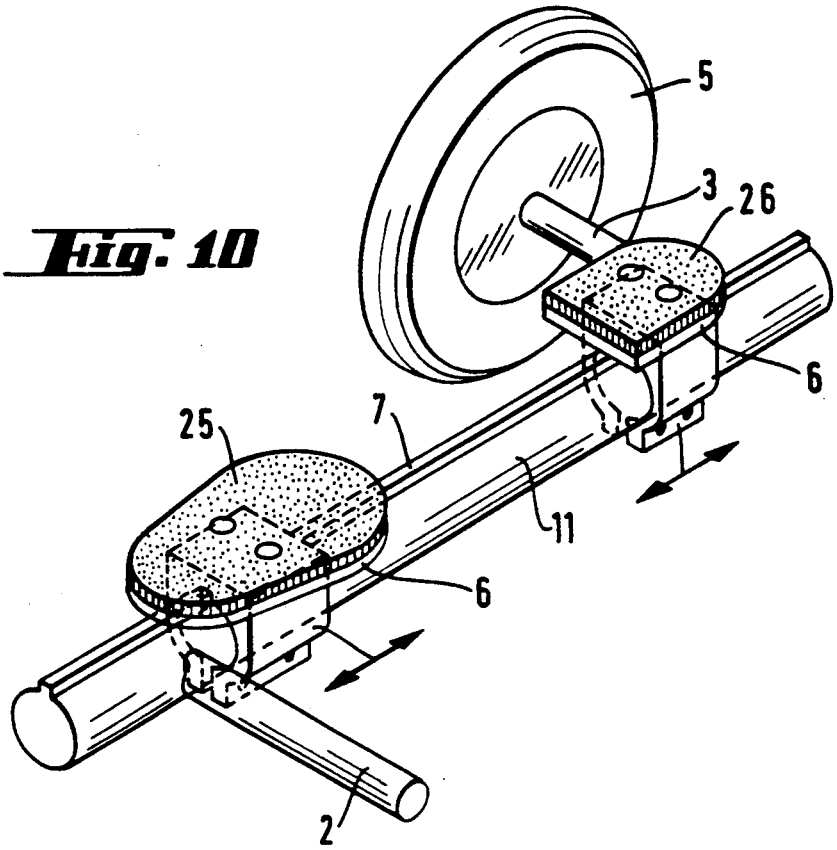
FIGS. 10 and 11 show 2 different embodiments of the adjustability of the shoe holders.
Figure 11:
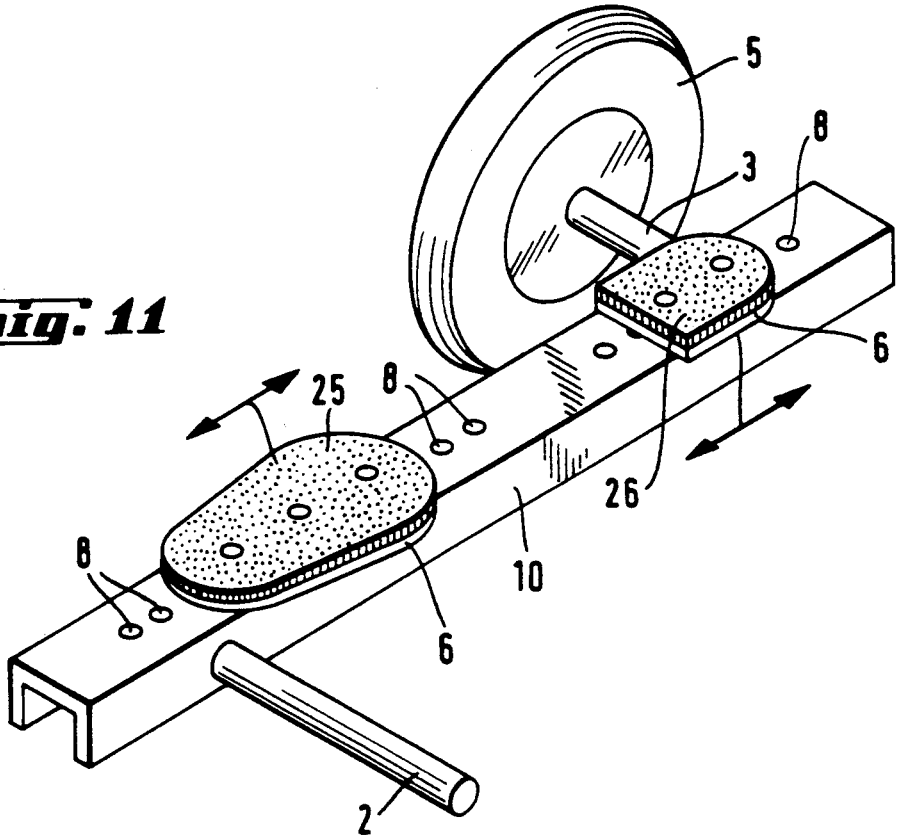

FIGS. 8, 10 and 11 show the asymmetric arrangement of the wheels 4, 5 on either side of the support 1, with a unilateral brake 15, in the form of belt brake, engaging the front wheel 4. The Bowden cable 21 in FIG. 9 is fixed to the support 1 by means of a Bowden cable guide 28. In FIG. 10, the shoe holder 6 can be adjusted by pushing it along the guide rails 7 in the support; in FIG. 11, it can be adjusted by fixing it by means of adjusting holes 8.

Figure 12:
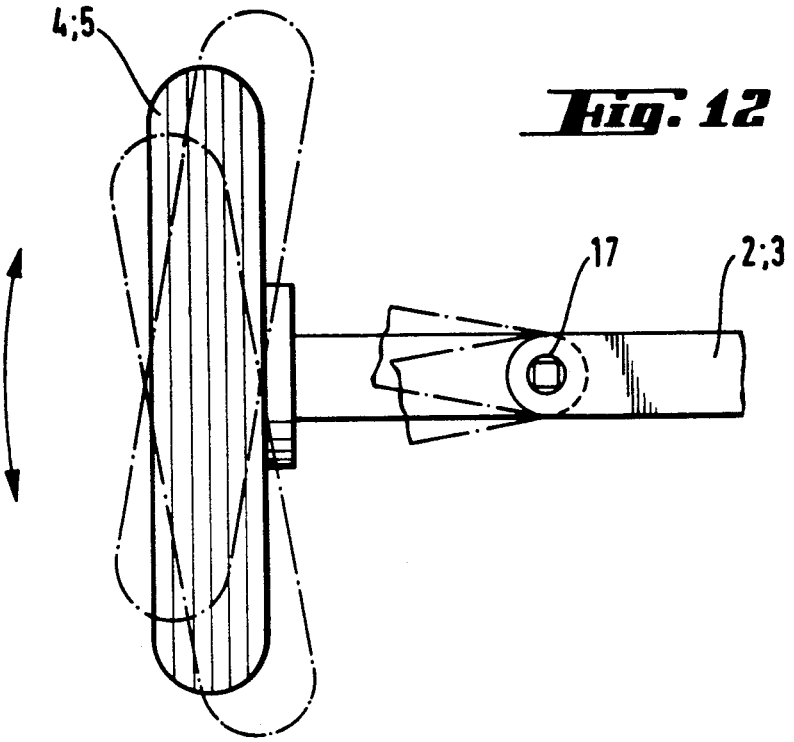
FIG. 12 shows an axis equipped with a joint with a built-in spring.

In FIG. 12, the axis 2,3 is provided with a joint 17 with a built-in spring, which serves as a shock absorber for the wheels 4, 5, particularly in uneven or rough country.

Figure 13:
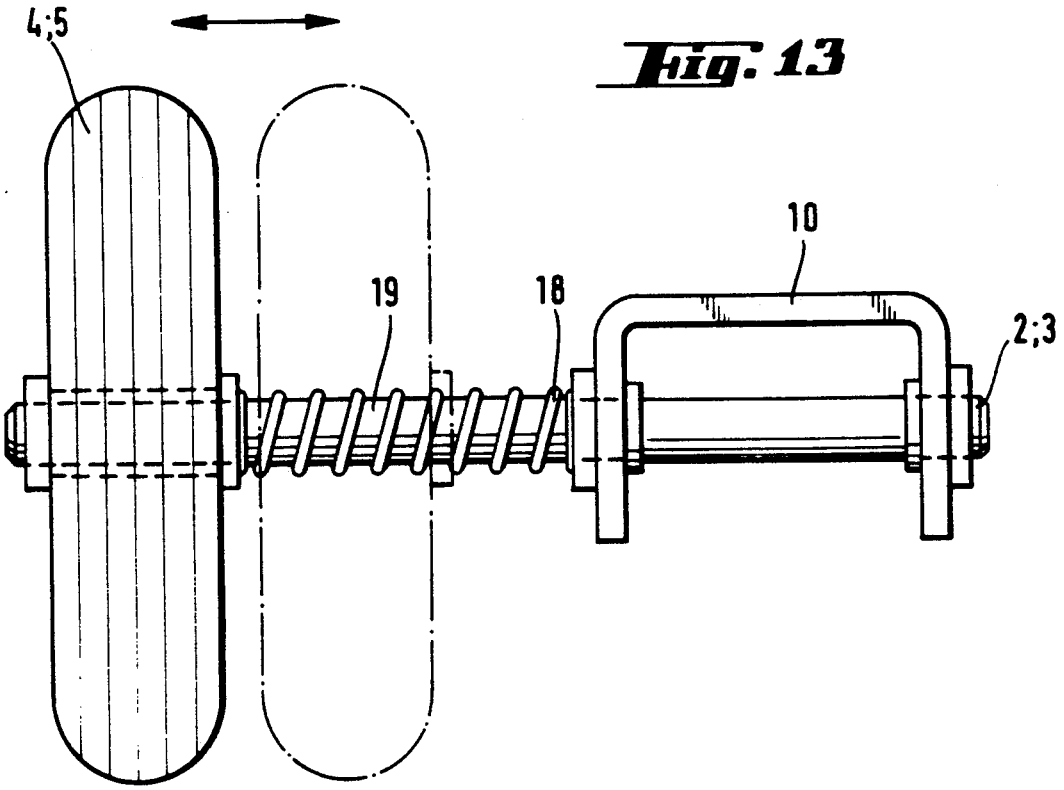
FIG. 13 shows the construction of an axis as a sliding axis.

In FIG. 13, the axis 2,3, disposed within the support 1, which is constructed here as an inverted U, is extended to the side and constructed as a sliding axis 19, on which the wheel 4 or 5 can slide, and forced by a spring 18 into outside position.

In FIG. 14, the support 1 is shifted toward the ground, so that it is approximately at the same height as the wheel axes 2, 3. At its two ends, the support 1 is arched upward and fastened with a clamp 33 to the horn plate 29.

The horn plate 29 is constructed in two parts, which intermesh in telescopic fashion. The lower part of the horn plate 29 is forked and accommodates the axes 2, 3, to which the wheels 4, 5 are fastened, within the fork 16. The front wheel 4 can be braked by a brake 15, which is constructed as a belt brake. The brake is operated by means of the Bowden cable 21. The support 1 is in two parts, the diameters of the two parts being such that the parts can be pushed into one another in telescope fashion, so that the gap of the shoe holder 6 can be varied in this manner. The pipe part of the support 1 with the wider diameter has at its end a slot 12, so that, after the required length of the support 1 is set and, with that, the necessary gap of the shoe holder 6, the clamp 9 can be tightened and the two parts of the pipe can be fixed in their relative position.

Figure 16:
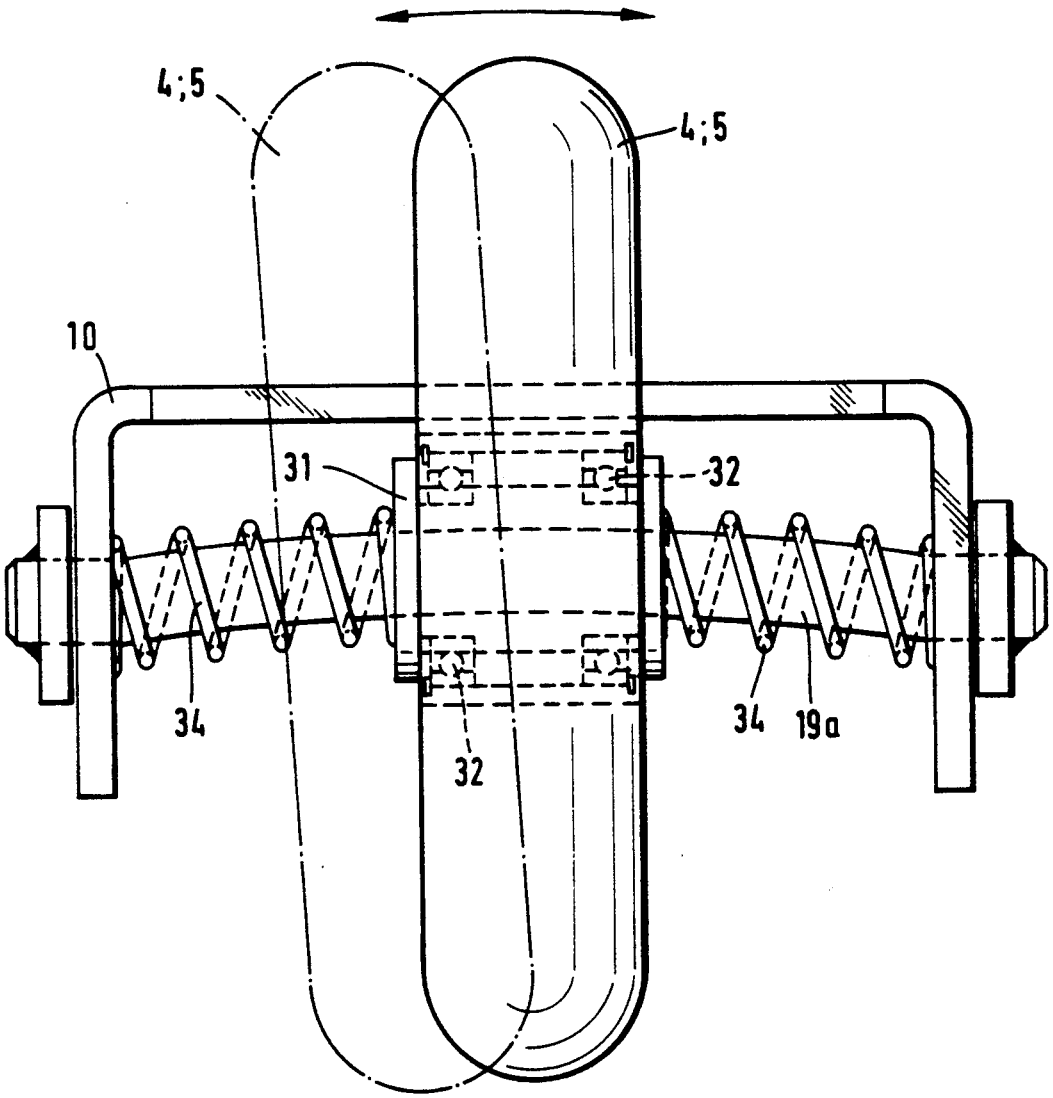
FIG. 16 shows the construction of an axis as a spiral gliding axis.

FIG. 16 shows the construction of the axis as a spiral gliding axis 19*a*. The wheels 4, 5 are supported on bearings 32 on a slipping sleeve 31 and can be shifted laterally against the force of pressure springs 34.

While the present invention has been illustrated with the aid of certain specific embodiments thereof, it will be readily apparent to others skilled in the art that the invention is not limited to these particular embodiments, and that various changes and modifications may be made without departing from the spirit of the invention or the scope of the appended claims.

I claim:

1. A sport equipment comprising a pair of short ski-like rollers for attachment to the shod feet of a user, each of said rollers comprising a support as a base for the shoe of the user, a shoe holder (6) for holding the user's shoe in place on said support, a front wheel and a rear wheel mounted for rotation on a pair of axes (2, 3) in said support, a brake system consisting of a friction brake for each of said wheels and a manual brake operating mechanism, said axes (2, 3) for attaching the wheels (4, 5) and the wheels themselves being disposed within the support (1), at least one of said axes (2, 3) being constructed as a spiral gliding axis (19*a*), on which a wheel (4) is mounted on bearings (32) on a slipping sleeve (31), said spiral gliding axis (19*a*) capable of being made inoperative by a catch.

* * * * *